US009962962B2

(12) United States Patent
Asamoto

(10) Patent No.: US 9,962,962 B2
(45) Date of Patent: May 8, 2018

(54) PRINTING APPARATUS

(71) Applicant: SEIKO EPSON CORPORATION, Tokyo (JP)

(72) Inventor: Katsuya Asamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days. days.

(21) Appl. No.: 15/409,282

(22) Filed: Jan. 18, 2017

(65) Prior Publication Data

US 2017/0203584 A1 Jul. 20, 2017

(30) Foreign Application Priority Data

Jan. 20, 2016 (JP) ..... 2016-008826

(51) Int. Cl.
*B41J 11/00* (2006.01)
*B41J 11/06* (2006.01)
*B41J 15/04* (2006.01)

(52) U.S. Cl.
CPC ..... *B41J 11/0085* (2013.01); *B41J 11/002* (2013.01); *B41J 11/06* (2013.01); *B41J 15/04* (2013.01)

(58) Field of Classification Search
CPC ..... B41J 11/0085; B41J 11/002
See application file for complete search history.

(56) References Cited

U.S. PATENT DOCUMENTS 6,116,728 A 9/2000 Miyake et al.
6,398,358 B1 6/2002 Miyake et al.
7,424,781 B2 9/2008 Fellingham et al.
2003/0081097 A1* 5/2003 Gil ..... B41J 11/002 347/102
2003/0128253 A1* 7/2003 Kitahara ..... B41J 2/155 347/42
2005/0151815 A1 7/2005 Kanai et al.
2010/0194816 A1 8/2010 Kanai et al.
2012/0162303 A1 6/2012 Sasaki
2012/0176439 A1 7/2012 Kanai et al.
2014/0063165 A1 3/2014 Sasaki
2014/0320564 A1 10/2014 Sasaki
2015/0197108 A1 7/2015 Sasaki
2016/0046135 A1 2/2016 Sasaki
(Continued)

FOREIGN PATENT DOCUMENTS

JP 05-301340 11/1993
JP 4429923 12/2009
JP 2010-188638 9/2010
(Continued)

*Primary Examiner* — Sharon A Polk
(74) *Attorney, Agent, or Firm* — Workman Nydegger

(57) ABSTRACT

A printing apparatus includes: a support section having heat transfer properties, the support section having a surface which serves as a support surface that can support a continuous sheet; a transporting section that transports the continuous sheet onto the support surface; and a print section that is disposed to face the support surface and performs printing onto the continuous sheet on the support surface. A plurality of suction holes are provided on the support section, at least one rib is provided to protrude at a position that does not interfere with the suction hole on a back surface of the support section, and a heat generator is provided on the rib.

6 Claims, 7 Drawing Sheets

(56) References Cited

U.S. PATENT DOCUMENTS

| | | | | |
|---|---|---|---|---|
| 2016/0101634 | A1* | 4/2016 | Suzuki | B41J 29/377<br>347/102 |
| 2016/0236486 | A1 | 8/2016 | Ikeda | |

FOREIGN PATENT DOCUMENTS

| | | |
|---|---|---|
| JP | 2012-135890 | 7/2012 |
| JP | 2015-074090 | 4/2015 |

* cited by examiner

PRINTING APPARATUS

BACKGROUND

1. Technical Field

The present invention relates to a printing apparatus such as an ink jet printer that performs printing on a medium, for example, by ejecting liquid onto the medium transported on a support table which supports the medium.

2. Related Art

As disclosed in JP-A-2015-74090, this type of printing apparatuses are known to have a heat generator provided on the back surface of a medium support section having a surface which serves as a support surface that supports a medium in a support table so as to dry the liquid attached on the medium which is supported on the support surface. Further, in such printing apparatuses, a plurality of suction holes are formed penetrating both surfaces of the medium support section in the support table, and a fan is provided on the back surface of the medium support section so as to suction air via the suction holes to thereby suction the medium onto the support surface. Accordingly, the printing apparatus can perform printing on the medium while preventing the medium from being lifted from the support surface.

In the printing apparatus disclosed in JP-A-2015-74090, the plurality of suction holes are formed to penetrate the medium support section having a surface which serves as the support surface for the medium. This decreases an area on which the heat generator can be mounted on the back surface of the medium support section. Accordingly, when the medium which is supported on the support surface is heated by the heat generator mounted on the back surface of the medium support section, it is difficult to obtain a heating value of the heat generator that is required to increase the temperature to dry the ink attached on the medium. In this regard, there is a need for improvement.

SUMMARY

An advantage of some aspects of the present invention is that a printing apparatus that provides a sufficient space for mounting a heat generator on the back surface of the medium support section is provided.

In the following section, means and effects for solving the above problem will be described. According to an embodiment of the invention, a printing apparatus includes: a medium support section having heat transfer properties, the medium support section having a surface which serves as a support surface that can support a medium; a transporting section that transports the medium onto the support surface; and a print section that is disposed to face the support surface and performs printing onto the medium on the support surface, wherein a plurality of suction holes are provided on the medium support section, at least one projection is provided at a position that does not interfere with the suction hole on a back surface of the medium support section, and a heat generator is provided on the projection.

With this configuration, the projection which protrudes at a position that does not interfere with the suction hole on the back surface of the medium support section can be used as a space for mounting the heat generator on the back surface of the medium support section. Accordingly, a sufficient space for mounting the heat generator can be provided on the back surface of the medium support section.

In the above printing apparatus, it is preferable that the projection is a rib which extends on the back surface of the medium support section, and the rib extends in a direction which intersects a transportation direction of the medium. With this configuration, the rib is increased in size by securing the length of the rib, which is an example of the projection, in a direction which intersects the transportation direction of the medium, which allows the space for mounting the heat generator on the rib to be increased. Accordingly, a sufficient space for mounting the heat generator can be further provided.

Further, in the above printing apparatus, it is preferable that a height dimension of the rib is larger than a thickness dimension of the rib in the transportation direction of the medium. With this configuration, the rib is increased in size by increasing the height dimension of the rib, which allows the space for mounting the heat generator on the rib to be increased. Accordingly, a sufficient space for mounting the heat generator can be further provided.

Further, in the above printing apparatus, it is preferable that the ribs are provided with a space in the transportation direction of the medium, and a height dimension of the rib on an upstream side in the transportation direction is larger than the height dimension of the rib on a downstream side in the transportation direction.

In the printing apparatus, for example, a fan for removing dust or the like attached on the medium may be provided upstream in the transportation direction of the medium relative to the medium support section. Since the dust or the like on the medium can be removed before printing is performed on the medium by the print section, print quality is improved. On the other hand, due to the fan, the medium in the medium support section on the upstream side in the transportation direction often becomes low temperature compared with the medium on the downstream side in the transportation direction.

In this regard, according to this configuration, the height dimension of the rib on the upstream side in the transportation direction in which the temperature of the medium in the medium support section is often lowered is increased to be larger than the height dimension of the rib on the downstream side in the transportation direction, thereby allowing the space for mounting the heat generator on the rib on the upstream side in the transportation direction to be larger than the space for mounting the heat generator on the rib on the downstream side in the transportation direction. Accordingly, the heat amount of the heat generator disposed on the rib on the upstream side in the transportation direction can be increased to be larger than the heat amount of the heat generator disposed on the rib on the downstream side in the transportation direction. As a result, the temperature of the medium supported in the region on the upstream side in the transportation direction on the support surface of the medium support section is facilitated to be increased.

Further, in the above printing apparatus, it is preferable that a plurality of ribs are disposed with a space in the transportation direction of the medium, and a heat amount per unit hour that the heat generator mounted on the rib on the upstream side in the transportation direction applies to the rib is larger than a heat amount per unit hour that the heat generator mounted on the rib on the downstream side in the transportation direction.

With this configuration, the heat amount of the heat generator mounted on the rib on the upstream side in the transportation direction is increased to be larger than the heat amount of the heat generator mounted on the rib on the downstream side in the transportation direction, thereby facilitating increase in temperature of the medium supported by the support surface on the upstream side in the transportation direction in the medium support section.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the drawings, an embodiment of a printing apparatus will be described. In this embodiment, the printing apparatus is an ink jet printer that ejects ink which is an example of liquid onto a continuous sheet which is an example of a medium so as to create characters and images on the continuous sheet.

Figure 1:
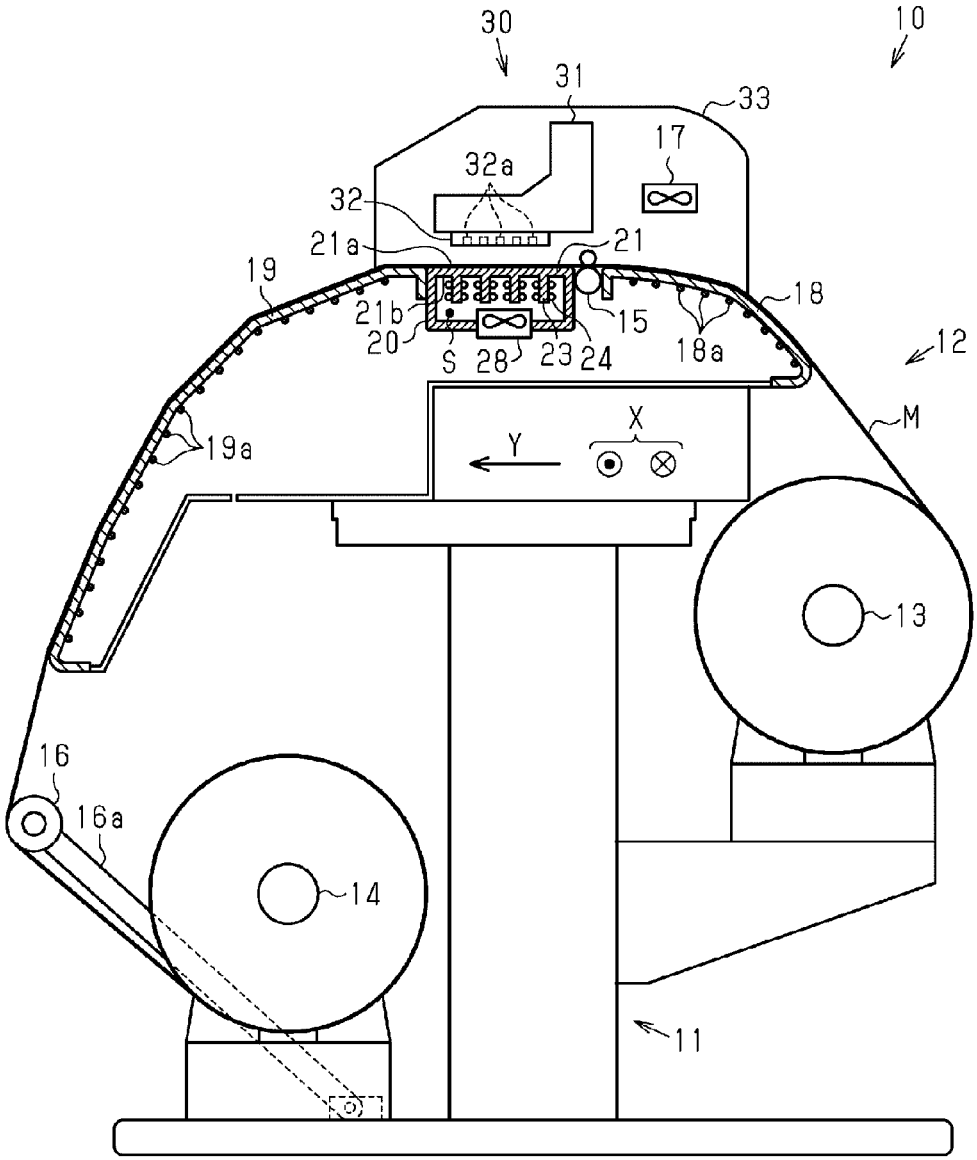
FIG. 1 is a schematic side view which shows a cross sectional configuration of an essential part of a printing apparatus according to one embodiment.

As shown in FIG. 1, a printing apparatus 10 includes a main body frame 11. The main body frame 11 includes a transporting section 12 that transports a continuous sheet M from upstream to downstream along a transportation path in a roll-to-roll method, a support table 20 that supports on the underside of the transported continuous sheet M at a position in the middle of the transportation path, and a print section 30 that performs printing on the continuous sheet M by ejecting ink onto the transported continuous sheet M.

The transporting section 12 includes a feeding shaft 13 that is disposed on an upstream side in the transportation path so as to support the continuous sheet M in the form of a roll and feeds out the continuous sheet M toward downstream in the transportation path, and a winding shaft 14 that is disposed on a downstream side in the transportation path and winds up the continuous sheet M fed out from the feeding shaft 13. The feeding shaft 13 and the winding shaft 14 are each rotatable about the axes which extend in a width direction (hereinafter, referred to as "width direction X", a direction perpendicular to the plane of the drawing of FIG. 1) which intersects a transportation direction (hereinafter, referred to as "transportation direction Y") of the continuous sheet M. The feeding shaft 13 is rotated by a feeding motor (not shown in the figure) in a direction by which the continuous sheet M is fed out, while the winding shaft 14 is rotated by a winding motor (not shown in the figure) in a direction by which the continuous sheet M is wound up. The width direction X of the present embodiment is perpendicular to the transportation direction Y.

The support table 20 is disposed to be opposed to the print section 30 with the continuous sheet M interposed therebetween. In other words, the print section 30 is disposed to face the support table 20 in a direction which intersects both the transportation direction Y and the width direction X. The support table 20 is formed in a box-shape having an inner space S. The support table 20 has a longitudinal direction extending in the width direction X, which is perpendicular to the transportation direction Y. Further, the support table 20 includes a support section 21 which is a medium support section having a surface which serves as a support surface 21*a* that supports the transported continuous sheet M.

In the transportation path, an air blow mechanism 17 for removing dust or the like attached on the continuous sheet M and an upstream support portion 18 that supports on the underside of the continuous sheet M are disposed upstream relative to the support table 20. The air blow mechanism 17 is located above the upstream support portion 18 and the support table 20, and includes a fan that blows air flow onto the continuous sheet M which is supported by the upstream support portion 18. An example of the fan is an axial fan. The upstream support portion 18 is disposed with a space from the support table 20 in the transportation direction Y. The upstream support portion 18 curves to become higher toward downstream in the transportation path. In the upstream support portion 18, an upstream heat generator 18*a* is provided to heat the continuous sheet M transported by the upstream support portion 18. An example of the upstream heat generator 18*a* is a surface heater such as an aluminum foil heater. Further, a fan of the air blow mechanism 17 may be of any type such as a centrifugal fan, as long as it can remove dust or the like on the continuous sheet M which is supported by the upstream support portion 18.

In the transportation path, a downstream support portion 19 that supports on the underside of the continuous sheet M is disposed adjacent to the support table 20. The downstream support portion 19 curves to become lower toward downstream in the transportation path. In the downstream support portion 19, a downstream heat generator 19*a* is provided to heat the continuous sheet M transported by the downstream support portion 19. An example of the downstream heat generator 19*a* is a surface heater such as an aluminum foil heater.

A pair of transportation rollers 15 is disposed between the upstream support portion 18 and the support table 20 in the transportation path so as to transport the continuous sheet M from upstream to downstream while nipping the continuous sheet M. The pair of transportation rollers 15 is rotated by the transportation motor (not shown in the figure) in a direction by which the continuous sheet M is transported from upstream to downstream in the transportation path. Accordingly, the transporting section 12 transports the continuous sheet M onto the support surface 21*a* of the support table 20.

A tension roller 16 is disposed between the downstream support portion 19 and the winding shaft 14 in the transportation path. The tension roller 16 applies tension on the transported continuous sheet M. As shown in FIG. 1, the tension roller 16 is rotatably supported by a distal end of a swing arm 16*a* whose proximal end is swingably supported by a main body frame 11. The tension roller 16 is disposed so as to be in contact with a back surface of the continuous sheet M which is supported by the support table 20 and the like. The tension roller 16 extends in the width direction X and is biased by the swing arm 16*a* with a constant force in a direction to press the continuous sheet M on a constant basis.

The print section 30 includes a carriage 31 disposed above the support table 20 and a print head 32 supported on the lower end of the carriage 31 to face the support table 20. The print section 30 is covered by a cover member 33 which is openably provided on the main body frame 11. Further, a small gap is formed between the cover member 33 and the transported continuous sheet M.

The carriage 31 is supported by a guide member (not shown in the figure) provided on the main body frame 11 so as to be reciprocatingly movable in the width direction X. The carriage 31 reciprocates in the width direction X by driving the carriage motor (not shown in the figure). On the surface of the print head 32 which faces the support table 20, a plurality of nozzles 32*a* that eject ink onto the continuous sheet M are open. Further, an ink cartridge (not shown in the figure) that supplies ink to the nozzles 32*a* is mounted on the carriage 31.

The print section 30 performs printing on the continuous sheet M on the support surface 21*a* by ejecting ink from the nozzles 32*a* of the print head 32 onto the continuous sheet M transported on the support surface 21*a* of the support table 20 while reciprocating the carriage 31 in the width direction X.

Figure 2:
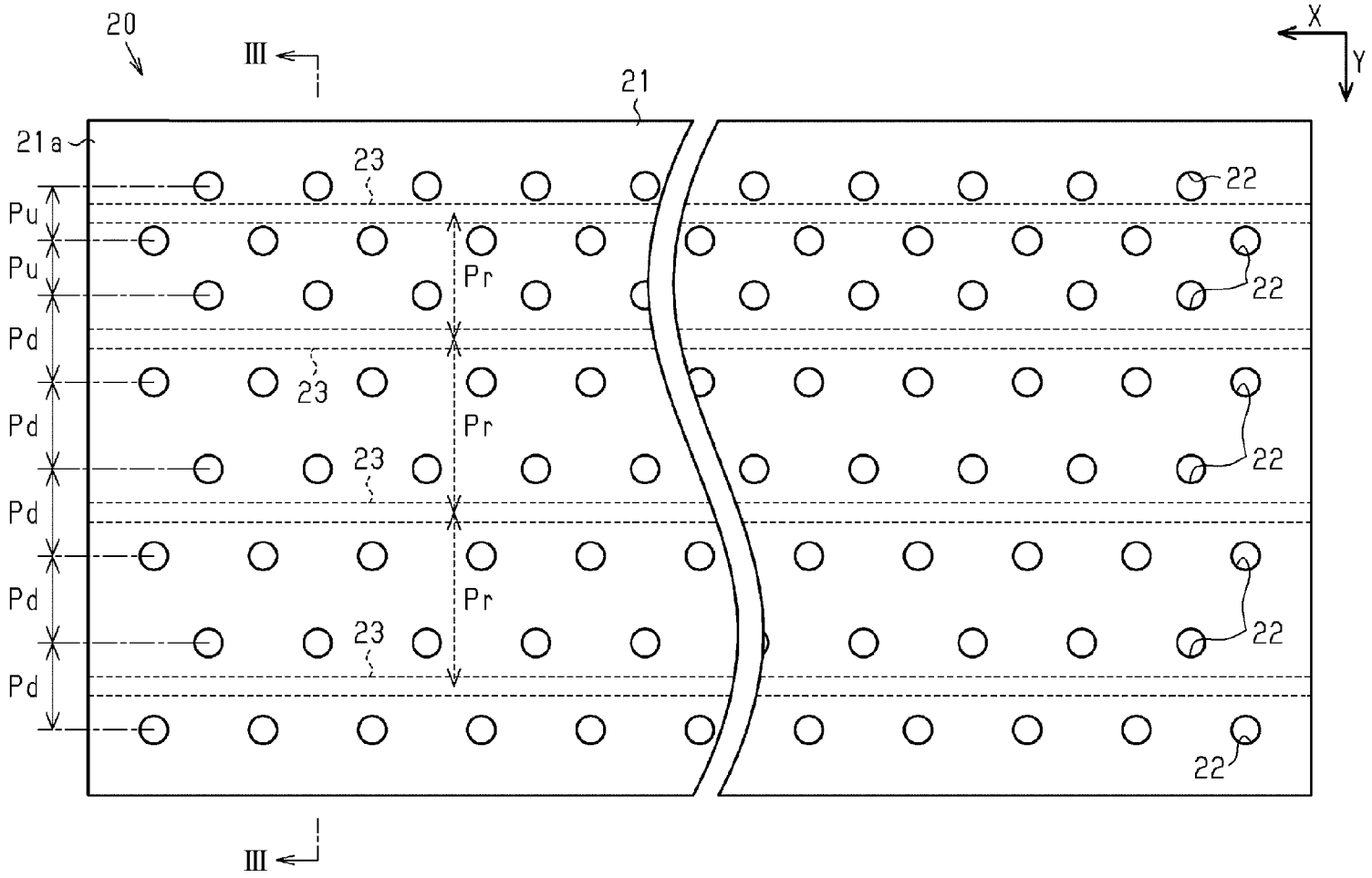
FIG. 2 is a schematic plan view which shows a support table of the printing apparatus of FIG. 1.
Figure 3:
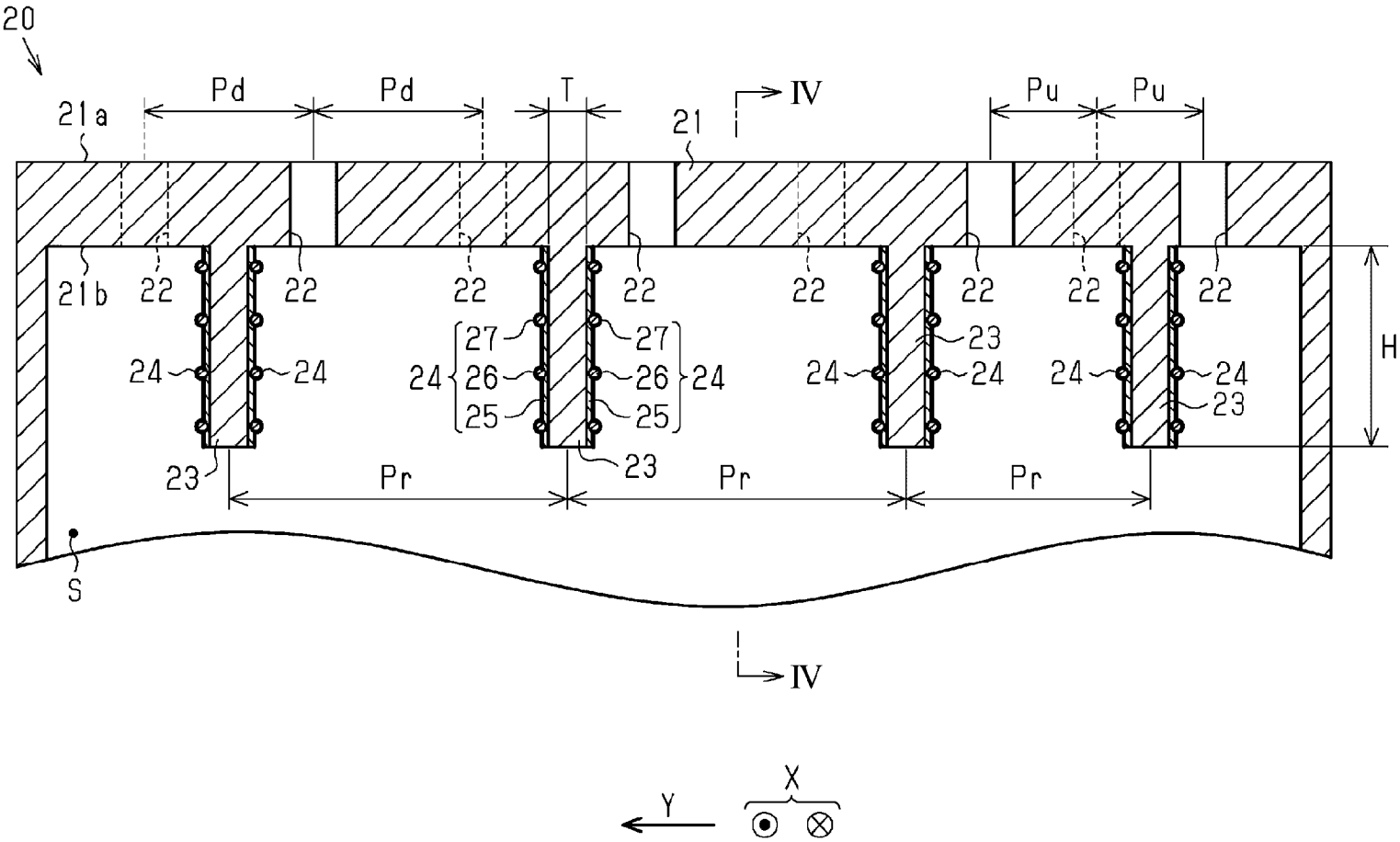
FIG. 3 is a cross sectional view taken along the arrow III-III of FIG. 2.

With reference to FIGS. 1 to 4, detailed configuration of the support table 20 will be described. As shown in FIG. 3, the support section 21 has a plurality of suction holes 22 that penetrate the support section 21 so as to communicate the front surface, a support surface 21*a*, with the back surface, a back surface 21*b*.

As shown in FIG. 1, a suction fan 28 is disposed on the lower side of the support section 21 of the support table 20 so as to suction the continuous sheet M transported on the support table 20 via the inner space S and the plurality of suction holes 22 (see FIG. 3) so that the continuous sheet M is attracted onto the support surface 21*a*. An example of the suction fan 28 is an axial fan. The suction fan 28 may be any type of fan such as a centrifugal fan, as long as it suctions the continuous sheet M transported on the support table 20 via the inner space S and the plurality of suction holes 22 so that the continuous sheet M is attracted onto the support surface 21*a*.

As shown in FIG. 2, the plurality of suction holes 22 are formed over the entire surface of the support surface 21*a* in the transportation direction Y and the width direction X. A pitch Pu of the plurality of suction holes 22 in the transportation direction Y on the upstream side of the transportation direction Y is smaller than a pitch Pd of the plurality of suction holes 22 in the transportation direction Y on the downstream side of the transportation direction Y. Accordingly, a suction force on the upstream side of the transportation direction Y of the support surface 21*a* where the continuous sheet M is more likely to be lifted from the support surface 21*a* becomes larger than the suction force on the downstream side of the transportation direction Y of the support surface 21*a*. This allows the continuous sheet M supported by the support surface 21*a* (see FIG. 1) to be stable in position. Further, the pitches Pu and Pd are distances between the centers of the suction holes 22 which are located at the closest positions in the transportation direction Y among the suction holes 22 at different positions in the transportation direction Y, that is, the distance between the centers of the suction holes 22 which are adjacent to each other in the transportation direction Y. The pitch Pu and the pitch Pd may also be equal to each other.

As shown in FIG. 3, ribs 23 (in this embodiment, four ribs 23), which are an example of a plurality of projections, are disposed on the back surface 21*b* of the support section 21 so as to protrude in a direction away from the support surface 21*a* (in FIG. 3, downward from the back surface 21*b*). More specifically, the ribs 23 are integrally formed with the support section 21 and protrude in a direction perpendicular to the support surface 21*a* and the back surface 21*b* of the support section 21 (in FIG. 2, a depth direction among the directions perpendicular to the plane of the drawing). In this embodiment, the support section 21 and the plurality of ribs 23 are formed by extrusion molding. Further, the support section 21 and the plurality of ribs 23 are made of aluminum which is one of materials having heat transfer properties. In addition, the support section 21 and the plurality of ribs 23 may be made of any material other than aluminum, such as copper, as long as the material has heat transfer properties. Further, the plurality of ribs 23 may be formed separately from the support section 21 and then assembled to the support section 21.

As shown in FIG. 2, the plurality of ribs 23 are provided on the back surface 21*b* of the support section 21 between the suction holes 22 adjacent to each other in the transportation direction Y, that is, at positions that do not interfere with the suction holes 22. Accordingly, the plurality of ribs 23 are disposed with a space in the transportation direction Y. Further, the plurality of ribs 23 extend over the entire surface of the support section 21 in the width direction X. A pitch Pr of the ribs 23 in the transportation direction Y is larger than either of the pitches Pu and Pd in the transportation direction Y of the suction hole 22. Further, the pitch Pr is a distance between the centers of the ribs 23 in the transportation direction Y which are adjacent to each other in the transportation direction Y. The dimension of the rib 23 in the width direction X may be smaller than the entire length of the support section 21 in the width direction X.

As shown in FIG. 3, the height dimension H of the ribs 23 is larger than the thickness dimension T of the ribs 23 in the transportation direction Y. Preferably, the height dimension H of the ribs 23 is larger than either of the pitches Pu and Pd of the suction holes 22 in the transportation direction Y. In this embodiment, the height dimensions H of the plurality of ribs 23 are the same, the thickness dimensions T of the plurality of ribs 23 are the same, and the dimensions in the width direction X of the plurality of ribs 23 are the same. Further, at least one of the dimensions in the width direction X of the plurality of ribs 23 may be different from the other dimensions in the width direction X of the ribs 23, or at least one of the thickness dimensions T of the plurality of ribs 23 may be different from the other thickness dimensions T of the ribs 23.

The plurality of ribs 23 are provided with heat generators 24. The heat generators 24 are disposed on both surfaces of the plurality of ribs 23 which intersect the transportation direction Y. An example of the heat generator 24 is an aluminum foil heater. The heat generator 24 may be other surface heaters than the aluminum foil heater.

Figure 4:
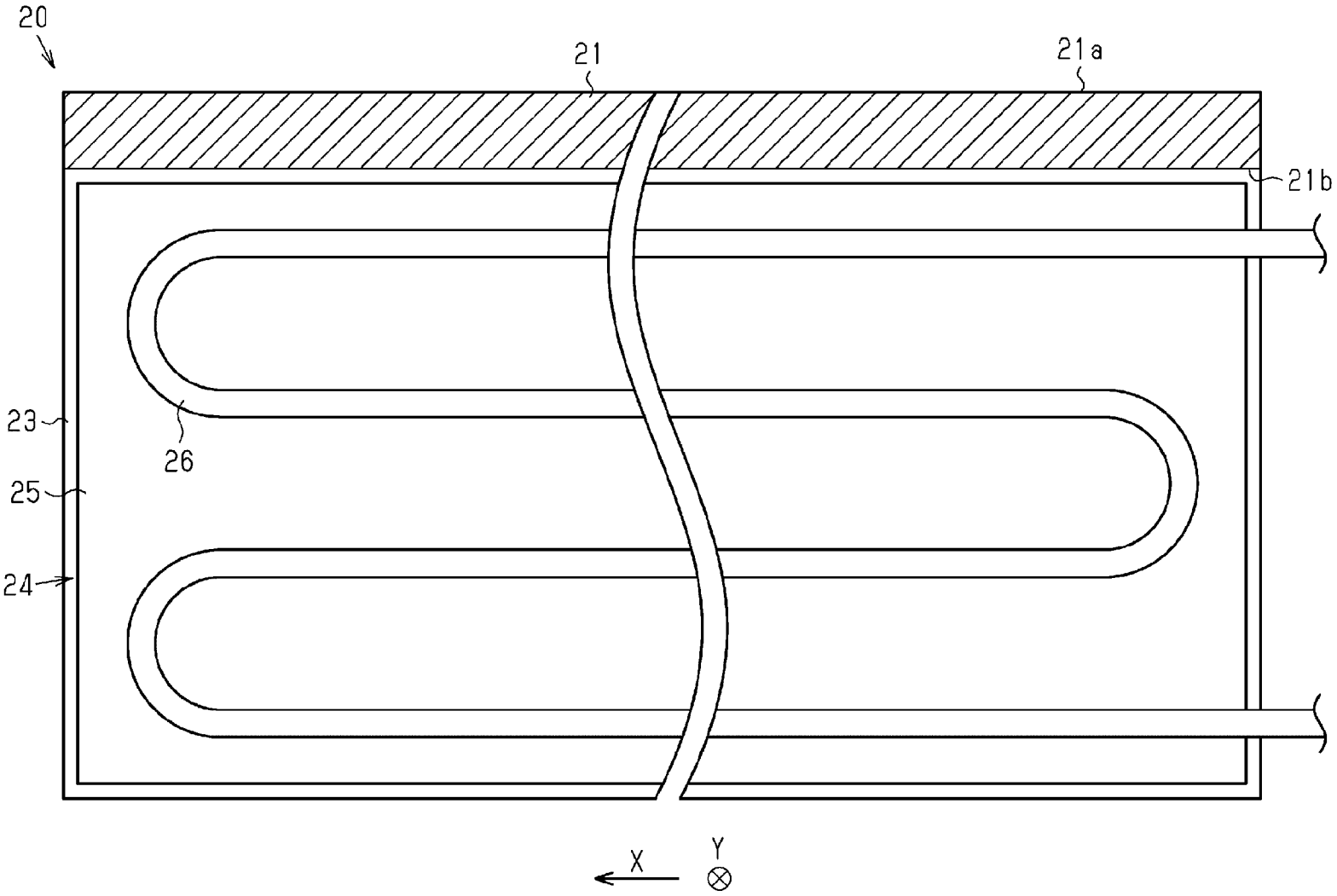
FIG. 4 is a cross sectional view taken along the arrow IV-IV of FIG. 3.

As shown in FIG. 4, the heat generator 24 is disposed on the substantially entire surface of the side surfaces of the rib 23 which intersect the transportation direction Y. The heat generator 24 is an aluminum foil heater in which a cord heater 26 is attached on one surface of a double sided tape 25, and an aluminum foil 27 (see FIG. 3) is attached over the entire surface of the double sided tape 25 to cover the cord heater 26. Further, the heat generator 24 is mounted on the side surfaces of the rib 23 via the double sided tape 25 having the other surface adhered to the side surface of the rib 23. The cord heater 26 is routed in a bellows shape as seen in the height direction of the rib 23. The heat generator 24 generates heat when power is supplied to the cord heater 26.

In FIG. 4, the aluminum foil 27 is not shown for convenience of illustration. Further, the heat generator 24 may not be necessarily disposed on the entire surface of the side surfaces that intersect the transportation direction Y of the rib 23, but may also be disposed on part of the side surfaces, as long as it can apply sufficient amount of heat on the rib 23. Furthermore, the routing manner of the cord heater 26 is an optional matter, and other form than a bellows shown in FIG. 4 is also possible.

Operation of the printing apparatus 10 having the above configuration will be described with reference to FIGS. 1 to 3. As shown in FIG. 1, when printing of the continuous sheet M is performed, the feeding shaft 13, the winding shaft 14 and the pair of transportation rollers 15 are first rotated, and the suction fan 28 is actuated. Accordingly, the continuous sheet M fed out from the feeding shaft 13 is transported to the upstream support portion 18, the support table 20 and the downstream support portion 19, in sequence. In so doing, the continuous sheet M on the support surface 21*a* is attracted onto the support surface 21*a* by the suction fan 28 via the plurality of suction holes 22 in order to ensure the print accuracy. Then, while the continuous sheet M is transported onto the support surface 21*a*, ink is ejected from the nozzles 32*a* of the print head 32 to thereby perform printing.

Here, in order to promote drying of ink on the continuous sheet M and reduce thermal effect to the nozzles 32*a* of the print head 32, the upstream heat generator 18*a*, the downstream heat generator 19*a* and the heat generators 24 are heated. Specifically, the upstream heat generator 18*a* is heated so that the upstream support portion 18 reaches a predetermined temperature (target temperature), the heat generators 24 are heated so that the support section 21 reaches a predetermined temperature (target temperature), and the downstream heat generator 19*a* is heated so that the downstream support portion 19 reaches a predetermined temperature (target temperature). In this embodiment, the target temperature of the support section 21 heated by the heat generator 24 is higher than the target temperature of the upstream support portion 18 and the downstream support portion 19 heated by the upstream heat generator 18*a* and the downstream heat generator 19*a*. Since the upstream support portion 18, the support table 20 and the downstream support portion 19 are heated as above, the continuous sheet M transported by the upstream support portion 18, the support table 20 and the downstream support portion 19 is also heated. Accordingly, the continuous sheet M is heated in the upstream support portion 18, which increases the temperature of the continuous sheet M before being transported to the support table 20. Since the continuous sheet M is already heated when it is transported onto the support table 20, the temperature of the continuous sheet M on the support surface 21*a* quickly increases to a temperature that facilitates drying of ink when the continuous sheet M is heated in the support section 21. Then, the continuous sheet M transported to the downstream support portion 19 is heated to thereby dry the ink on the continuous sheet M which has not been dried on the support surface 21*a*.

In particular, as shown in FIG. 2, since the plurality of suction holes 22 are formed in the support table 20, a space which is available for mounting the heat generators 24 (see FIG. 3) on the back surface 21*b* of the support section 21 is small. However, the present embodiment can provide a sufficient space for mounting the heat generator 24, since the heat generators 24 are mounted on the side surfaces of the plurality of ribs 23 which intersect the transportation direction Y as shown in FIG. 3. Accordingly, the amount of heat that the heat generators 24 applies on the ribs 23 increases. Since the heat is transferred to the support section 21 via the ribs 23, the support section 21 can be quickly heated to a target temperature.

According to the present embodiment, the following effects can be achieved. (1) The plurality of ribs 23 are provided on the back surface 21*b* of the support table 20, and the side surfaces of the plurality of ribs 23 which intersect the transportation direction Y provide a space for mounting the heat generator 24. Since the plurality of ribs 23 protrude downward from the back surface 21*b* in the inner space S of the support table 20, a sufficient space for mounting the heat generator 24 can be provided without increasing the size of the support table 20.

(2) Since the plurality of ribs 23 extend in the width direction X, an area of the side surfaces of the plurality of ribs 23 which intersect the transportation direction Y is increased. Accordingly, a sufficient space for mounting the heat generator 24 can be provided on the plurality of ribs 23. In addition, the heat of the heat generators 24 can be transferred to a large area in the width direction X of the support surface 21*a* via the plurality of ribs 23.

(3) Since the height dimension H of the rib 23 is larger than the thickness dimension T of the rib 23, an area of the side surfaces of the plurality of ribs 23 which intersect the transportation direction Y is increased. Accordingly, a sufficient space for mounting the heat generator 24 can be provided on the plurality of ribs 23.

In particular, since the plurality of ribs 23 extend on the entire support section 21 in the width direction X, an area of the side surfaces of the plurality of ribs 23 which intersect the transportation direction Y is further increased. Accordingly, a sufficient space for mounting the heat generator 24 on the plurality of ribs 23 can be easily provided. Since the heat generators 24 are mounted on the substantially entire surface of the side surfaces of the plurality of ribs 23 which intersects the transportation direction Y, the amount of heat applied to the support section 21 is further increased. Accordingly, the support surface 21*a* of the support section 21 can be more quickly heated to a target temperature. In addition, since the heat generators 24 can heat the entire support surface 21*a* in the width direction X via the plurality of ribs 23, the entire continuous sheet M in the width direction X of various sheet widths can be easily heated.

(4) Since the support section 21 and the plurality of ribs 23 are integrally formed, the support table 20 can be easily manufactured compared with the case where the support section 21 and the plurality of ribs 23 are separately formed and then assembled together. In addition, since an air layer is not formed between the plurality of ribs 23 and the support section 21, heat of the heat generator 24 can be efficiently transferred from the plurality of ribs 23 to the support section 21.

(5) Using an aluminum foil heater as the heat generator 24 can reduce cost compared with the case where, for example, a tube type heater is used for the heat generator 24. Further, since the heat generators 24 are mounted on the plurality of ribs 23 by being adhered to the plurality of ribs 23 via the double sided tape 25, the heat generators 24 can be easily mounted on the plurality of ribs 23 compared with the case where the tube type heater is mounted on the plurality of ribs 23 in the support section 21 or where the tube type heater is embedded in the plurality of ribs 23.

(6) Since the heat generators 24 are mounted on both side surfaces of the ribs 23 which intersects the transportation direction Y, the surface of the ribs 23 can be effectively used as a mounting space for the heat generators 24, thereby increasing the amount of heat applied by the heat generator 24 to the rib 23.

(7) Since the pitch Pr of the ribs 23 adjacent in the transportation direction Y is larger than either of the pitches Pu and Pd of the suction holes 22 adjacent in the transportation direction Y, the heat generators 24 may be easily mounted between the ribs 23 which are adjacent in the transportation direction Y.

MODIFIED EXAMPLES

The above embodiment may be changed as described in the following modified examples. Further, the above embodiment and the following modified examples may be combined as appropriate.

Figure 5:
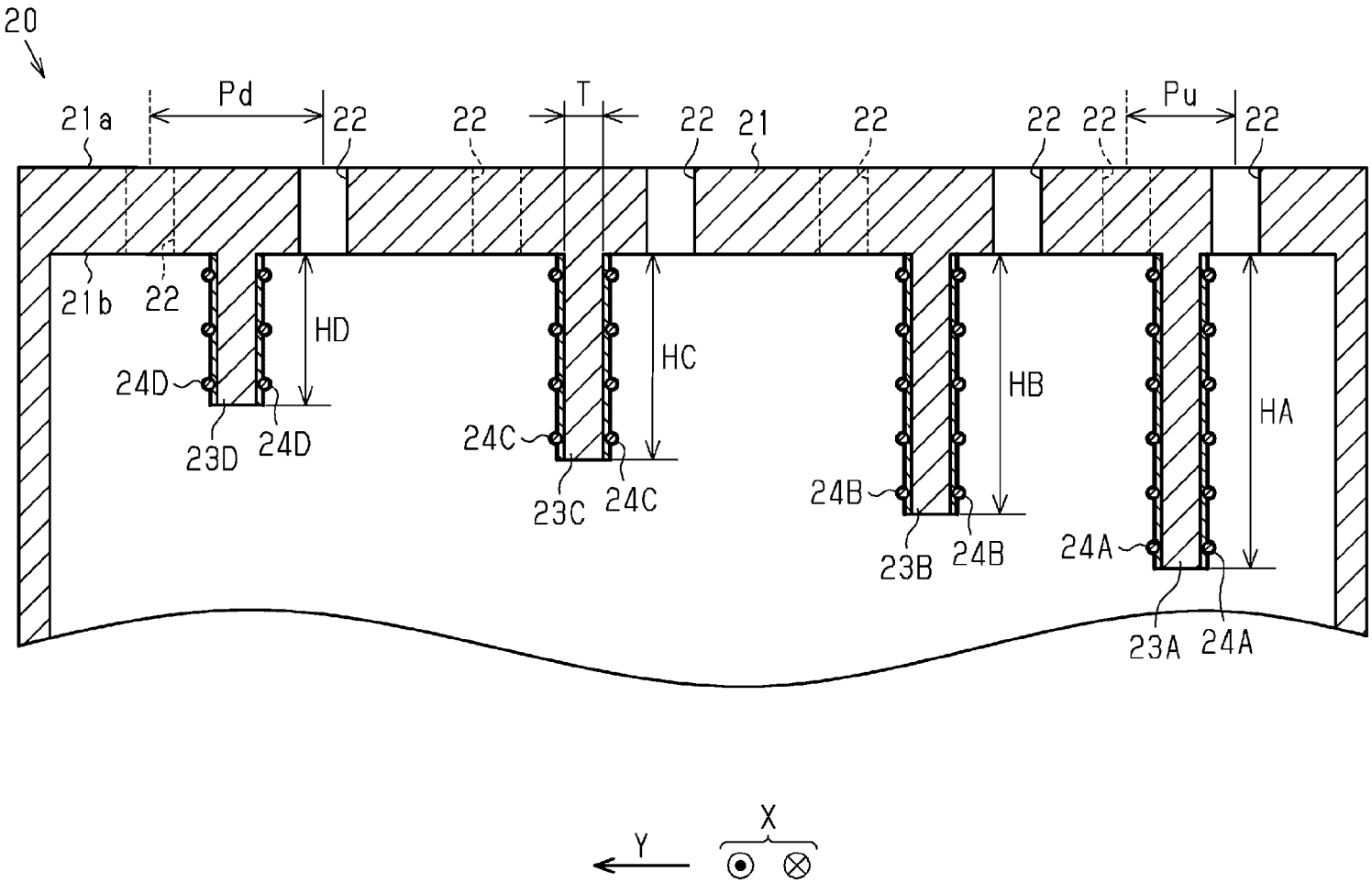
FIG. 5 is a schematic cross sectional view which shows a cross sectional configuration of the support table of the printing apparatus according to a modified example.

The projections which can be used as a mounting space for the heat generator 24 may not be limited to a plate shaped rib 23, and may be projections of columnar shape, conical shape or the like. The height dimension of the plurality of ribs 23 is a matter of option. For example, as shown in FIG. 5, ribs 23A, 23B, 23C and 23D, which are disposed in the support section 21 from upstream to downstream in the transportation direction Y, each have the height dimensions, HA, HB, HC and HD, which increase toward upstream in the transportation direction Y (HA>HB>HC>HD). The ribs 23A, 23B, 23C and 23D include heat generators 24A, 24B, 24C and 24D, respectively. These heat generators have sizes which increase in the order of the heat generators 24D, 24C, 24B and 24A. Accordingly, the heat amount per unit hour applied from the heat generators increases in the order of the ribs 23A, 23B, 23C and 23D. Therefore, the temperature of the support surface 21*a* of the support section 21 on the upstream side in the transportation direction Y is higher than that on the downstream side. Further, the smallest height dimension HD is larger than either of the thickness dimension T of the ribs 23A, 23B, 23C and 23D and the pitches Pu and Pd of the suction holes 22. Moreover, the configuration of the heat generators 24D, 24C, 24B and 24A is the same as the heat generators 24 of the above embodiment.

In this configuration, for example, the continuous sheet M transported to the upstream support portion 18 is cooled by the air blow mechanism 17 (see FIG. 1) which removes dust or the like attached on the continuous sheet M. Since a larger amount of heat is applied on the continuous sheet M (see FIG. 1) which is cooled by air on the upstream side in the transportation direction Y relative to the support surface 21*a*, the amount of reduction in temperature of the continuous sheet M can be complemented.

Figure 6:
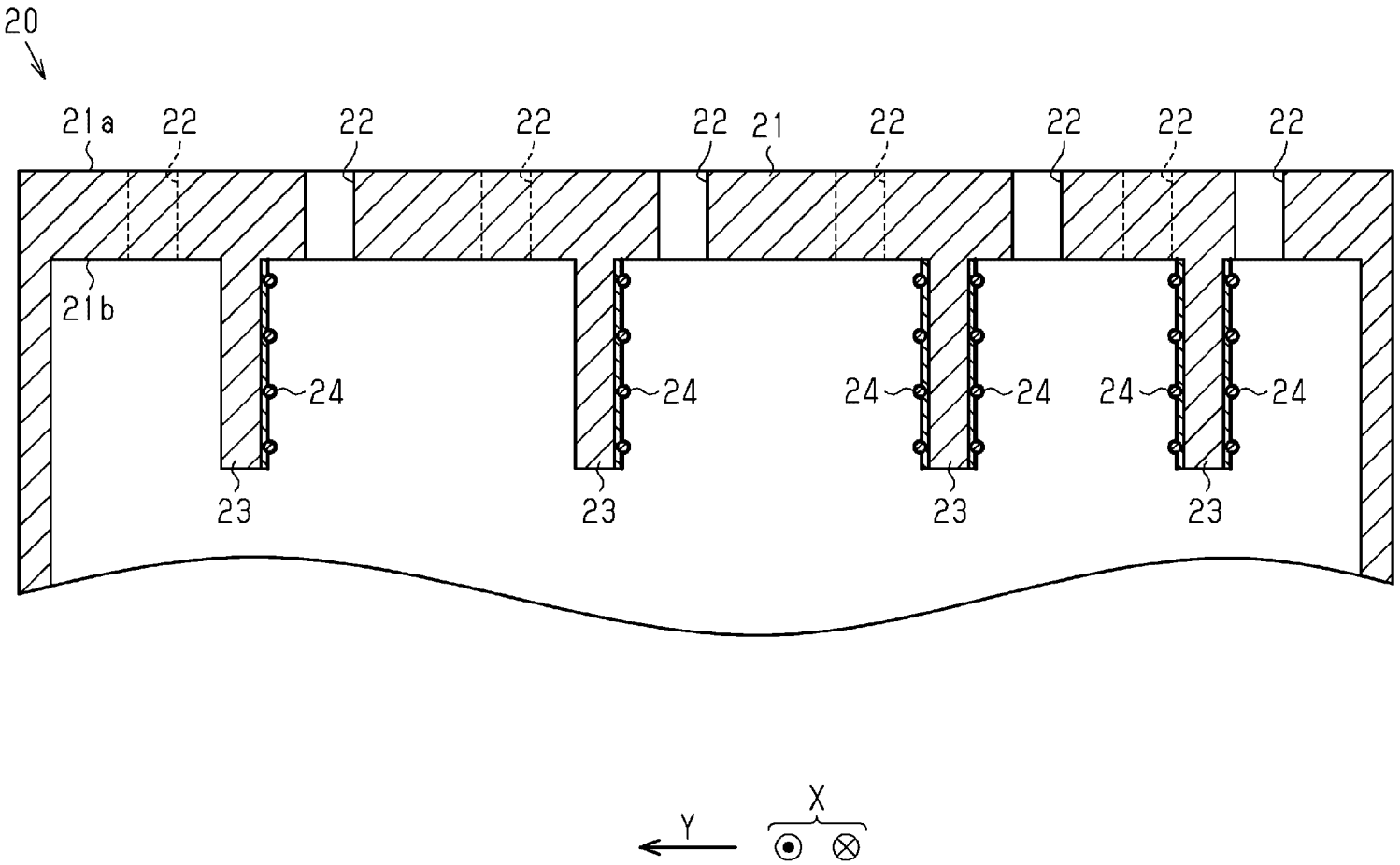
FIG. 6 is a schematic cross sectional view which shows a cross sectional configuration of the support table of the printing apparatus according to another modified example.

The heat generators 24 of the above embodiment are mounted on both surfaces which intersect the transportation direction Y of the rib 23. However, the invention is not limited thereto, and the heat generators 24 may be mounted only on one surface of the rib 23 which intersects the transportation direction Y of the rib 23. For example, as shown in FIG. 6, the heat generators 24 may be mounted on both surfaces of two ribs 23 on the upstream side in the transportation direction Y, and the heat generators 24 may be mounted on one surface of two ribs 23 on the downstream side in the transportation direction Y. Accordingly, the heat amount per unit hour applied from the heat generators 24 to the ribs 23 on the upstream side in the transportation direction Y becomes larger than the heat amount per unit hour applied from the heat generators 24 to the ribs 23 on the downstream side in the transportation direction Y. Therefore, the temperature of the support surface 21*a* of the support section 21 on the upstream side in the transportation direction Y is higher than that on the downstream side. As a result, the continuous sheet M transported on the upstream side in the transportation direction Y on the support surface 21*a* is heated, which causes the temperature to easily increase.

The heat generators 24 with different output (W) may be mounted on the plurality of ribs 23. For example, the heat generators 24 having high output are mounted on the ribs 23 on the upstream side in the transportation direction Y, and the heat generators 24 having low output are mounted on the ribs 23 on the downstream side in the transportation direction Y. Accordingly, the heat amount per unit hour applied from the heat generators 24 to the ribs 23 on the upstream side in the transportation direction Y becomes larger than the heat amount per unit hour applied from the heat generators 24 to the ribs 23 on the downstream side in the transportation direction Y. Therefore, the temperature of the support surface 21*a* of the support section 21 on the upstream side in the transportation direction Y is higher than that on the downstream side. As a result, the continuous sheet M transported on the upstream side in the transportation direction Y on the support surface 21*a* is heated, which causes the temperature to easily increase.

The plurality of heat generators 24, which are smaller than the width direction X of the side surface which intersects the transportation direction Y of the rib 23 may be mounted on the rib 23 so as to be arranged in the width direction X. The heat generator 24 may be a tube heater instead of a surface heater such as aluminum foil heater. In this case, the tube heater may be embedded in the rib 23.

Figure 7:
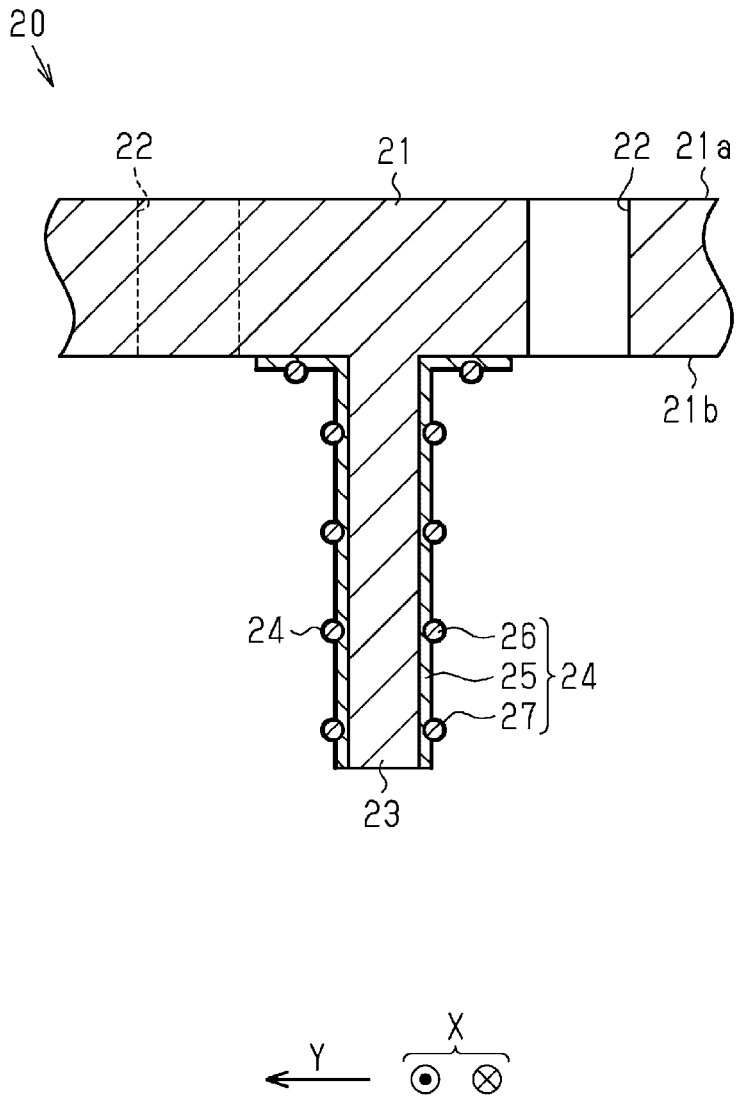
FIG. 7 is a schematic cross sectional view which shows a partial cross sectional configuration of the support table of the printing apparatus according to still another modified example.

As shown in FIG. 7, part of the heat generator 24 may be mounted on the back surface 21*b* of the support section 21. This allows the part of the heat generator 24 to directly heat the support section 21, thereby efficiently heating the support section 21. Accordingly, the support section 21 can be quickly heated to reach a target temperature.

At least one of the upstream heat generator 18*a* of the upstream support portion 18 and the downstream heat generator 19*a* of the downstream support portion 19 may be omitted. Further, at least one of the upstream support portion 18 and the downstream support portion 19 may be omitted.

The print section 30 may be modified to a so-called line head which has an elongated print head that corresponds to the entire width direction X of the support table 20 is fixedly provided. In the print section 30, instead of a so-called on carriage type in which the ink cartridge is mounted on the carriage 31, a so-called off carriage type in which the ink cartridge is mounted on a mounting section (not shown in the figure) provided in the main body frame 11 may be used.

The printing apparatus 10 is not limited to a configuration having only a printing function, but may be a multifunction machine. The medium is not limited to the continuous sheet M, but may be a cut-sheet, resin film, metal foil, metal film, composite film of resin and metal (laminated film), fabric, non-fabric, ceramic sheet or the like.

The recording material used for printing may be a fluid other than ink (including liquid, liquid body made of particles of the functional material dispersed or mixed in liquid, fluid body such as gel, and solid body that can be sprayed as a fluid). For example, a configuration to perform printing by ejecting liquid body which contains dispersed or dissolved materials such as electrode materials and color materials (pixel material) used for manufacturing liquid crystal displays, electroluminescence (EL) displays and surface emitting displays may also be possible.

Further, the printing apparatus 10 may be a fluid body ejecting apparatus that ejects a fluid body such as a gel (for example, physical gel), or a particulate ejecting apparatus (for example, toner jet type recording apparatus) that ejects a solid, for example, powder (particulate) such as toner. Further, the term "fluid" as used herein is a concept that does not include a fluid made of only gas, and the fluid includes, for example, liquid (including inorganic solvent, organic solvent, solution, liquid resin, liquid metal (metal melting) and the like), liquid body, fluid body, particulate (including particles and powder) and the like.

The printing apparatus 10 is not limited to a printer that performs printing by ejecting fluid such as ink, as long as the printer is configured to heat the continuous sheet M. For example, the printing apparatus 10 may be a non-impact printer such as laser printers, LED printers, heat transfer printers (including sublimation type printers), or impact printer such as dot impact printers.

This application claims priority under 35 U.S.C. § 119 to Japanese Patent Application No. 2016-008826, filed Jan. 20, 2016. The entire disclosure of Japanese Patent Application No. 2016-008826 is hereby incorporated herein by reference.

What is claimed is:

1. A printing apparatus comprising:

a medium support section having heat transfer properties, the medium support section having a surface which serves as a support surface that can support a medium;

a transporting section that transports the medium onto the support surface; and a print section that is disposed to face the support surface and performs printing onto the medium on the support surface, wherein a plurality of suction holes are provided on the medium support section, at least one projection is provided at a position that does not interfere with the suction hole on a back surface of the medium support section, and a heat generator is provided on the projection.

2. The printing apparatus according to claim 1, wherein the projection is a rib which extends on the back surface of the medium support section, and the rib extends in a direction which intersects a transportation direction of the medium.

3. The printing apparatus according to claim 2, wherein a height dimension of the rib is larger than a thickness dimension of the rib in the transportation direction of the medium.

4. The printing apparatus according to claim 2, wherein a plurality of ribs are provided with a space in the transportation direction of the medium, and a height dimension of the rib on an upstream side in the transportation direction is larger than the height dimension of the rib on a downstream side in the transportation direction.

5. The printing apparatus according to claim 2, wherein a plurality of ribs are provided with a space in the transportation direction of the medium, and a heat amount per unit hour that the heat generator mounted on the rib on the upstream side in the transportation direction applies to the rib is larger than a heat amount per unit hour that the heat generator mounted on the rib on the downstream side in the transportation direction.

6. The printing apparatus according to claim 1, wherein the heat generator is disposed on substantially the entire surface of the at least one projection.

* * * * *